US005322012A

United States Patent [19]

Gartner et al.

[11] Patent Number: 5,322,012

[45] Date of Patent: Jun. 21, 1994

[54] METHOD AND SYSTEM FOR THE LATERAL ALIGNMENT OF SHEETS

[75] Inventors: Arno Gartner, Sinntal; Peter Mayer, Muhlheim am Main, both of Fed. Rep. of Germany

[73] Assignee: MAN Roland Druckmaschinen AG, Fed. Rep. of Germany

[21] Appl. No.: 7,541

[22] Filed: Jan. 22, 1993

[30] Foreign Application Priority Data

Jan. 24, 1992 [DE] Fed. Rep. of Germany ..... 4201886

[51] Int. Cl.[5] ..... B41F 13/24

[52] U.S. Cl. ..... 101/232; 101/242; 271/227; 271/236; 271/250

[58] Field of Search ..... 101/232, 233, 242; 400/579, 630, 633; 271/227, 228, 236, 248, 250

[56] References Cited

U.S. PATENT DOCUMENTS

| | | | |
|---|---|---|---|
| 3,964,828 | 6/1976 | Yamada et al. | 355/10 |
| 4,260,149 | 4/1981 | Melzer | 271/250 |
| 4,591,143 | 5/1986 | Jeschke | 271/227 |
| 4,615,520 | 10/1986 | Jeschke et al. | 271/250 |

*Primary Examiner*—Edgar S. Burr
*Assistant Examiner*—Ren Yan
*Attorney, Agent, or Firm*—Leydig, Voit & Mayer, Ltd.

[57] ABSTRACT

A method and system are provided for aligning the lateral edge of sheets fed to a printing press. The lateral position of a sheet is detected. A slidable suction device beneath the sheet is operated to pull the sheet toward a lateral abutment at a constant speed, the suction being applied at an individual time for each sheet in accordance with the detected position. Suction pressure is released when the sheet reaches the side lay, such that suction pressure is only applied for the time necessary to place the sheet in proper registration.

14 Claims, 2 Drawing Sheets

METHOD AND SYSTEM FOR THE LATERAL ALIGNMENT OF SHEETS

FIELD OF THE INVENTION

This invention relates generally to sheet processing machines, and more particularly to a pneumatic method and system for laterally aligning sheets along a side abutment for sheet printing machines.

BACKGROUND

Prior to feeding a sheet to a sheet processing machine such as a printing press, it is desirable to position the sheet in correct registration, i.e., to properly align the front and side edges of the sheet. Generally, as sheets are initially fed in a forward direction, the front edge of the sheet is first aligned on front lays (forward abutments), followed by a procedure for accomplishing the side edge alignment. Various methods and systems have attempted to effect this side edge alignment, including systems that perform the lateral alignment along a fixed side lay, i.e., lateral abutment, or without such a side lay.

For example, U.S. Pat. No. 3,743,277 (corresponding to German Patent DE 2 046 602) discloses a device which attempts to achieve lateral sheet alignment without a side lay. After the front edge of each sheet is aligned on front lays, the side position of the sheet is detected with a measuring head, and then compared with an ideal position value to determine the difference. As a result, the amount of lateral movement necessary to laterally align the sheet is known. A transversely displaceable suction pulling strip or a drum disposed in the feed table moves the sheet laterally in accordance with the obtained difference measured.

However, because this prior system does not utilize a side lay, not only must the lateral position measurement be extremely precise, therefore requiring complex circuitry, but the side-pulling means must not even slightly skew the sheet during its operation since no lateral abutment is present to readjust sheets that have shifted during the movement.

Another sheet alignment method and device that attempts to align sheets without a side lay is disclosed in U.S. Pat. No. 4,613,125 (corresponding to German Patent DE 3 301 722). In this method, the sheet is similarly aligned entirely by measuring and without utilizing a lateral abutment, by first aligning the front edge of a sheet and then laterally moving the sheet beyond a measuring zone. When the sheet exceeds the zone, a scanning device is completely cleared, thereby triggering a signal indicating that the sheet is positioned at a known lateral location. An additional movement over a fixed distance places the sheet in registration.

Again, since there is no fixed side lay, the lateral position measurement must be extremely precise, requiring sensitive scanning means, and the side-pulling means must not even slightly skew the sheet during the movement, otherwise the angled sheet will trigger the scanner improperly and remain aligned improperly.

U.S. Pat. No. 4,264,068, (corresponding to German Patent DE 2 851 935), assigned to the present assignee, discloses a sheet alignment mechanism that includes a side lay. The sheet is moved against the side lay by a pneumatic side-pulling suction means which is disposed beneath the feed table and operates in synchronization with the incoming sheets. The pneumatic side-pulling means includes an interchangeable suction device that moves in a reciprocating fashion by being mechanically coupled to a control cam. A bleed valve controls the amount of suction pressure so that the sheet slides over the surface of the moving suction means once the sheet edge abuts the side lay. The sliding continues until a valve block with a rotary plate valve is opened, which occurs when the side-pulling means has reached a certain limit and pressure is released.

With this prior system the pneumatic pulling means operates in synchronization with the incoming sheets, and suction is applied from the moment that the suction plate is pulled. As a result, because the lateral positions of the sheets vary prior to alignment, different sheets are moved different distances before reaching the side lay, and sheets are held against the side lay until the suction pressure is released for different lengths of time. Although once the sheets reach the side lay the suction pressure is such that the sheets slide over the surface of the suction means, some inertial and frictional forces are present. Thus the sheets strike the side lay at varying speeds and are forced slightly into the side lay, which causes rebounding from the side lay once released.

When printing machine speeds are high, (for example when exceeding 12,000 sheets per hour), this frictional force along with the inertial forces of the sheets and other dynamic conditions unpredictably influence the speed that the sheet initially strikes the side lay and the distances that the various sheets rebound when they are held for varying lengths of time against the side lay. As a result, at these higher speeds sheets cannot be consistently transferred to the processing machine in perfect registration, and poor operating results occur.

Finally, since these systems reciprocate continuously, the suction means must travel an extra distance toward the lateral abutment before uncovering an inlet port to apply suction. This is necessary so as to not suck in the sheets before they aligned on the front lays, while still keeping the suction means in synchronization with the incoming sheets. Thus, the overall reciprocation speed had to be increased to account for this extra distance traveled. Accordingly, because the forces differ as a function of the speed and distance that the sheets are pulled, at particularly high speeds sheets have a tendency to sustain edge damage, particularly when certain grades of paper are used.

SUMMARY OF THE INVENTION

Accordingly, it is an object of the present invention to provide a method and system for reliable and precise lateral sheet alignment.

It is another object of the invention to provide such a method and system that utilizes a side lay for the lateral alignment.

It is a further object of the invention to provide such a method and system that operates consistently at all processing machine speeds.

It is also a further object of the invention to prevent damage to the side edges of the sheet during the lateral alignment regardless of the type of sheet being processed.

It is still another object of the invention to prevent sheets from rebounding unpredictably during alignment.

It is yet another object of the invention to provide such a method and system that is relatively simple and inexpensive to implement and operate.

It is a resulting feature of the invention that sheets remain on the front lays for a finite period of time and therefore have additional time to align in the forward direction.

In accordance with the invention, there is provided a method for laterally positioning sheets to be processed, the method first comprising the step of feeding one sheet in a forward direction until it reaches the forward abutments. When the sheet is aligned on the forward abutments, a slidable suction means having a perforated upper surface disposed beneath the sheet is moved in the direction of the lateral abutment, and an initial lateral position of the sheet relative to a lateral abutment is detected. Suction pressure is applied at an appropriate time through the perforated upper surface of the slidable suction means thereby coupling the sheet to the perforated upper surface of the suction means and pulling the sheet towards the lateral abutment as the slidable suction means moves laterally. The time of the application of suction depends on the detected initial lateral position of the sheet such that the sheet will align alongside the lateral abutment at essentially the same time that the slidable suction means reaches a maximum lateral displacement position. The suction pressure is released when the slidable suction means has reached this maximum displacement position. The slidable suction means then returns to an initial position away from the lateral abutment.

A system for laterally aligning sheets on a feed table of a sheet processing machine is similarly provided and comprises means for aligning the forward edge of the sheets, preferably forward abutments, and a lateral abutment. Sensing means are utilized to detect the lateral position of each sheet relative to the lateral abutment, and output a signal corresponding to the position when the forward edge of the sheet is in alignment. A slidable suction means, disposed in the feed table and having an upper surface flush with the feed table, with at least one aperture for applying suction therethrough is also provided, along with means for moving the slidable suction means in a lateral direction at an essentially constant rate of speed toward and away from the lateral abutment. Means for controllably applying suction through the upper surface of the slidable suction means include an electrically-operable valve such as a solenoid pneumatically coupled to a constant source of suction. A control means responsive to the signal output from the sensing means and electrically coupled to the means for controllably applying suction, directs the application of suction through the upper surface of the slidable suction means to couple the sheet to the upper surface and laterally pull the sheet towards the lateral abutment at a time dependent on the signal from the sensing means. Means release the suction when the suction means reaches a maximum lateral displacement which corresponds to the sheet being aligned on the lateral abutment.

Thus the application of suction to align sheets laterally is delayed as a function of the lateral distance that the sheet must travel to be aligned. As a result, sheets are held against the lateral abutment for only a relatively short length of time prior to their release regardless of their initial lateral position. Accordingly, the surface of the suction means slides under every sheet the same minimal amount prior to the release of suction and thus the sheets rebound consistently even at high press speeds.

Finally, since the suction is typically applied through a solenoid, no extra lateral movement by the side-pulling means to uncover an inlet port is required. Thus, the side-pulling means can be moved at a lower speed than are prior systems regardless of the machine speed, further reducing sheet rebounding effects and damage to the edges of the sheet.

Other objects and advantages will become apparent from the following detailed description when taken in conjunction with drawings, in which:

DETAILED DESCRIPTION OF THE PREFERRED EMBODIMENT

While the invention will be described in connection with the preferred embodiment, there is no intent to limit it to that embodiment. On the contrary, the intent is to cover all alternatives, modifications, and equivalents within the spirit and scope of the invention as defined by the appended claims.

Figure 1:
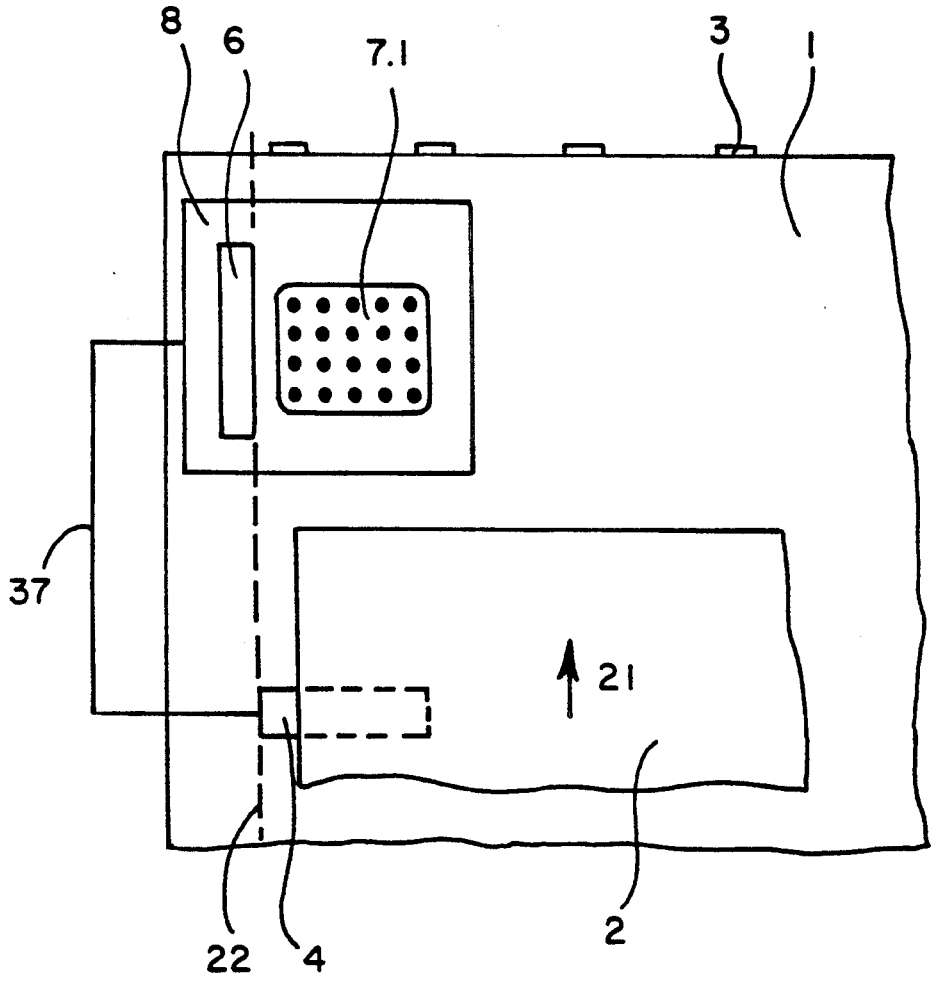
FIG. 1 is a plan view showing the arrangement of the sheet alignment means according to the invention.

Turning now to the drawings and referring first to FIG. 1, there is shown a feed table 1 on which a single sheet 2 is moving toward a set of front lays 3, the forward direction of the sheet movement being represented by directional arrow 21. Although only a single sheet 2 is illustrated, it can be readily appreciated that the invention is intended to operate with multiple sheets, which are ordinarily fed to the front lays 3 in an essentially continuous stream in an overlapping relationship, after first having been separated by a sheet feeder 35. A sensing means 4 is disposed to detect the lateral position of sheet 2 relative to the edge of a side lay 6, (i.e., lateral abutment) which extends along imaginary line 22. The side lay 6 is fixed on the feed table 1, preferably on a cover plate 8.

The sensing means 4 is fixed relative to the feed table 1 at a position that is upstream (as considered relative to the direction of sheet feed 21) of the side lay 6, and has a first end in alignment with the side lay 6, that is, along imaginary line 22. The second end of the sensing means 4 extends outwardly toward the sheet, preferably having a length (corresponding to a measuring range) that is equal to the maximum range of lateral sheet movement. The maximum range of lateral sheet movement is restricted to the maximum displacement of a sucker 7 (including perforated sucker surface 7.1) that is integrated in a side-pulling means 30 (see FIG. 2). Preferably the sensing means 4 comprises an optical sensor (such as a reflection measuring head) disposed in the feed table, however other types of sensors known in the art (for example LED arrays with associated detectors) can be alternatively utilized for the measurement. Alternatively, a reflection-type sensor can be positioned above the sheet if a simple reflective surface (not shown) is disposed below the sheet.

During sheet feeding, for a short time a condition exists wherein the preceding sheet (not shown) has been transferred to a printing cylinder (not shown) by an auxiliary gripper (not shown). At this time the front edge of the current sheet 2 becomes aligned on the front lays 3, and the following sheet (not shown) has not reached the surface 7.1 of sucker 7 (See FIG. 2). During this time, the sensing means 4 is disposed to detect the lateral sheet position of sheet 2, but not the position of the following sheet.

To engage the underside of the sheet and to move it laterally into the side lay 6, a sucker 7 is provided, including the perforated sucker surface 7.1 which is flush with the surface of feed table 1. In the preferred embodiment, to enable the alignment of each new sheet, (such as sheet 2), sucker 7, (and perforated surface 7.1), is initially positioned to the sheet side of the side lay 6 at its maximum possible displacement in that direction, although still in relatively close proximity to the side lay 6. As a result, sheets which are within the lateral detection range of sensing means 4 can be coupled by suction to perforated surface 7.1 of sucker 7 whenever suction pressure (i.e., a negative pressure) is applied at perforated surface 7.1 as described below.

Figure 2:
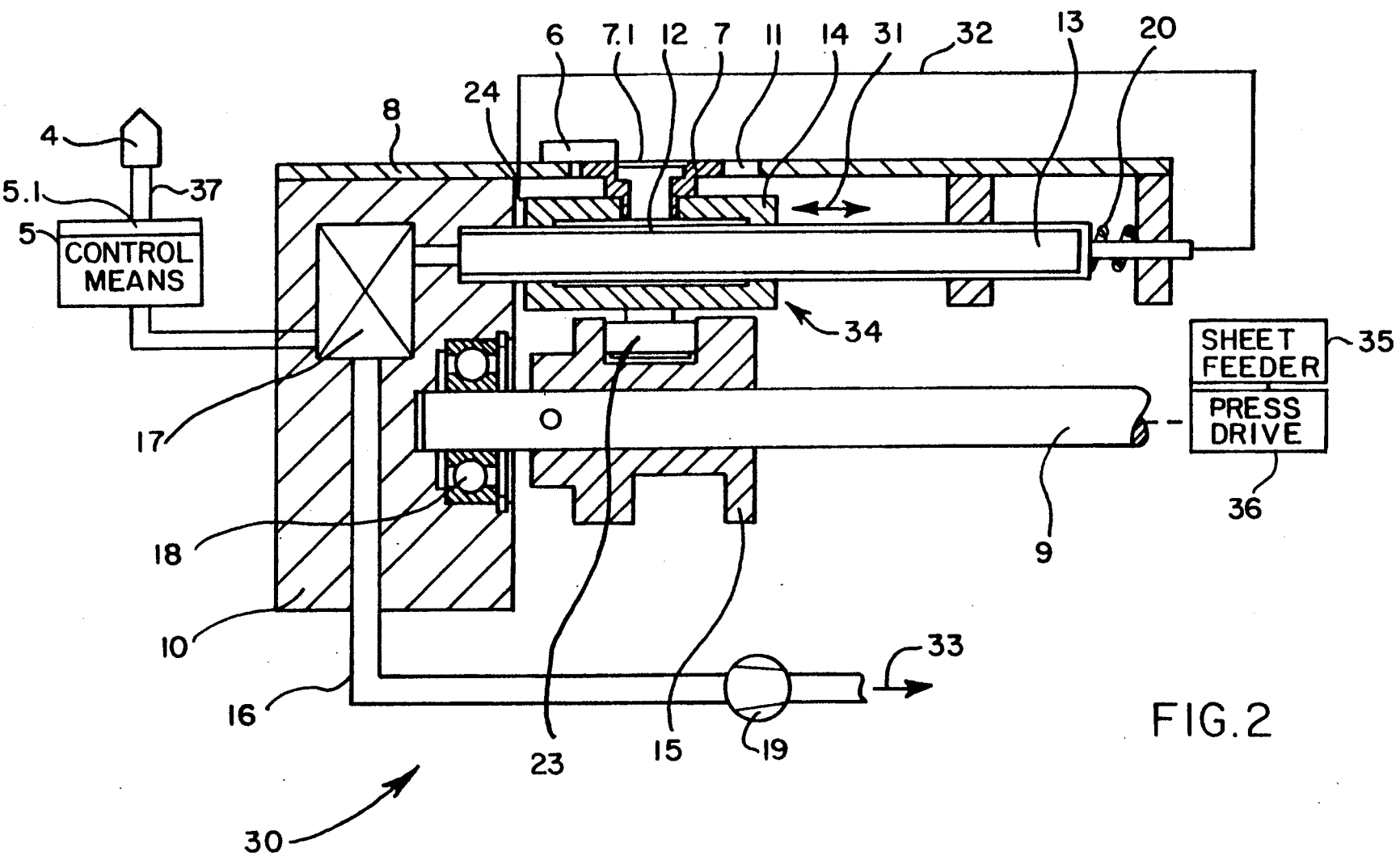
FIG. 2 is a view in vertical section illustrating the side-pulling means according to the invention.

Turning to FIG. 2, the side-pulling means generally designated 30 comprises a valve housing 10 in which a drive shaft 9 is supported by radial bearings 18 and coupled to a press drive 36. A helical control cam 15 is fixed on the drive shaft 9 and engages cam follower 23, whereby cam follower 23 moves in reciprocating motion as the control cam 15 rotates with the drive shaft 9. It can be readily appreciated that while the preferred embodiment of the invention utilizes such a system for achieving reciprocating motion, other arrangements are conceivable for accomplishing a similar result without departing from the spirit and scope of the invention as defined by the appended claims.

Cam follower 23 is rigidly coupled to a slide 14 mounted for lateral displacement along a suction tube 13 which is mounted to the valve housing 10 and disposed parallel to the drive shaft 9. Thus as cam follower 23 moves, the slide 14 reciprocates along the suction tube 13 causing the attached sucker 7, including perforated surface 7.1, to likewise move in reciprocating motion, as indicated by directional arrow 31.

The suction tube 13 includes an aperture 12 dimensioned such that air can be drawn through the perforated surface 7.1 and the sucker 7 over the entire range of movement of the slide 14. The sucker 7 is mounted for movement with the slide 14 in a recess 11 extending beneath the side lay 6 and is preferably incorporated in the cover plate 8. For ease of understanding, the sucker 7, the perforated surface 7.1 and the slide 14 are defined as comprising slidable suction means 34. The perforated surface 7.1 is made of any suitable material, such as plastic, and includes at least one aperture for drawing air therethrough into the sucker 7. Preferably, the sucker 7 and the perforated sucker surface 7.1 are designed to be easily interchangeable with other such suckers (not shown) of varying surfaces and/or perforation patterns in order to optimally conform to the various characteristics of sheets being processed.

An electrically-operated valve, such as a solenoid valve 17 located in the valve housing 10 is pneumatically coupled between a first end of the suction tube 13 and a suction airline 16. In the preferred embodiment, the suction airline 16 is connected to a constant source of suction 19, preferably a suction pump, such that air is exhausted in the direction indicated by the directional arrow 33. The operation of the solenoid valve 17 is electrically controlled by a control means 5, the control means 5 including a signal transducer 5.1 coupled to the sensing means 4 through a line 37 for determining when to apply suction as a function of the measured lateral position of the sheet as described below.

A valve 20, preferably a disc valve, is disposed at a second end of the suction tube 13, and when opened acts as an inlet port for coupling the suction tube 13 to atmosphere. The valve 20 is electrically connected through a line 32 or other appropriate circuitry (such as a relay or driver, not shown) to an end-positioned pressure release switch 24 disposed on the valve housing 10. The pressure release switch 24 is actuated by the slide 14 to open the valve 20 when the slidable suction means 34 reaches its maximum displacement beneath the side lay 6.

The system operates as sheets, which were previously separated by a sheet feeder 35 are fed to the front lays 3 via the feed table 1, which is preferably an inclined feed table and which may be a suction belt table. As one sheet 2 abuts the front lays 3, the preceding sheet (not shown) has already been transferred to the next stage of the processing operation by an auxiliary gripper (not shown). Accordingly, the sheet 2 is no longer covered by the formerly overlapping preceding sheet and the following sheet (not shown) has not yet reached the side-pulling means 30.

At this time, the sucker 7 (including the perforated surface 7.1) which continually moves in reciprocating fashion has just changed its direction of movement back towards the side lay 6. However, in accordance with the invention, suction is not immediately applied, and the sheet 2 does not yet move laterally. Simultaneously, the sensor 4 measures the lateral position of the sheet, preferably by cooperating with the transducer 5.1 through the line 37 to produce a voltage having a magnitude corresponding to the distance required for alignment.

The sensor 4, typically a reflection measuring head, is fixed to detect the lateral position of the sheet 2 upon the feed table 1. Based on the lateral position of the sheet 2 as detected by the sensor 4, the individual pull distance required to bring the edge of the sheet 2 into lateral alignment with the side lay 6 is known. The distance measurement is fed to the control means 5 by the signal transducer 5.1, preferably as a voltage signal. Based on this measured distance, a time to activate suction is determined such that the sheet 2 will reach the side lay 6 at the approximate moment that the slide 14 actuates the pressure release switch 24.

It can be readily appreciated that the control means 5 for operating the solenoid 17 to enable the suction at the appropriate time could be conceived in many various ways. For example, since sensors and associated transducers typically produce a voltage corresponding to the distance detected, a simple microcomputer (not shown) and an analog-to-digital voltage converter (not shown) could be utilized to generate a signal after an appropriate delay time that is easily determined from either a look-up table or by executing a simple formula. It can likewise be appreciated that other simple analog or digital electronic circuitry could accomplish the same actuation timing, as all that is required is to operate the solenoid at a time that is earlier during the sliding time of sucker 7 (shorter delay time) when sheets are initially further from the side lay 6, and later (longer delay time) when sheets are initially nearer the side lay 6.

Regardless of the circuitry utilized to time the operation of the solenoid 17, in order to apply suction, the source of suction 19 continually pumps air out of the suction airline 16 in the direction indicated by the directional arrow 33, so that a negative pressure is always available at the solenoid 17. During the movement of the sucker 7, the valve 20, controlled by pressure release switch 24, remains closed. Thus, as soon as the solenoid 17 is opened, the suction pressure exists through the perforated surface 7.1.

After the delay time (determined by the control means 5 based on the distance measurement received from the sensor 4 and the transducer 5.1), the control means 5 opens the solenoid 17 thus applying suction to the underside of the sheet 2. Thus, the sheet 2 becomes coupled by suction pressure to the perforated surface 7.1, and likewise travels towards the lateral abutment 6. When the slidable suction means 34 reaches its maximum displacement underneath the side lay 6, it actuates the switch 24 (via the slide 14), thus opening the valve 20 to atmosphere quickly releasing the suction pressure.

Although sheets are thus released from the sucker 7 soon after being aligned on the side lay 6, the sheets are not immediately released due to delay times inherent in opening of the valve 20 and finite times required to equalize pressure. This delay in the release time is advantageous because any sheets which are slightly askew are pulled into alignment on the side lay 6 before being released during this delay time. However, to prevent damage to the sheet, it is necessary to provide a suction pressure and a perforated surface 7.1 which allow the sheets to slide over the perforated surface 7.1 once the side lay 6 is reached. If necessary, an adjustable air bleed valve (not shown), coupled to any suitable location such as the suction tube 13, can be added to control the amount of suction pressure applied. Nevertheless, it is an important aspect of the invention that the amount of time during which sheets are in contact with the side lay 6 and sliding occurs is minimal and is essentially the same for all sheets regardless of their initial lateral position. This reduces the amount and unpredictability of sheet rebound from the side lay 6.

As can be seen from the foregoing detailed description, a simple, inexpensive and reliable method and system is provided for facilitating the alignment of sheets to be fed to a sheet processing machine. By delaying the time for applying suction as determined by a sensor and a simple control means, all sheets reach the side lay at essentially the moment pressure is released, regardless of their initial lateral position. Since the time is always a finite time, an additional advantage of the invention is that sheets are given the maximum possible settling time at the front lays before being pulled to the side lays, and the speed of the side-pulling means can be reduced.

What is claimed is:

1. A method for laterally positioning at least one sheet to be processed in a sheet processing machine, the method comprising the steps of:

feeding the sheet in a forward direction until it reaches at least one forward abutment;

moving a slidable suction means having an apertured upper surface disposed beneath the sheet in the direction of a lateral abutment;

detecting an initial lateral position of the sheet relative to the lateral abutment and determining the time required for the sheet to reach its maximum lateral displacement;

communicating suction pressure through the perforated upper surface of the suction means thereby coupling the sheet to the perforated upper surface of the suction means for pulling the sheet towards the lateral abutment as the slidable suction means moves laterally, and applying suction pressure through the apertured upper surface of the suction means for a predetermined interval corresponding to the determined time required such that the sheet will align alongside the lateral abutment at substantially the same time that the suction means reaches a maximum lateral displacement position; and releasing the suction pressure when the slidably suction means has reached the maximum displacement position.

2. The method of claim 1 further comprising the step of returning the slidable suction means to an initial position away from the lateral abutment after releasing the suction pressure.

3. The method of claim 2 wherein the slidable suction means moves in reciprocating motion from an initial lateral position towards the maximum displacement position beneath the lateral abutment and back towards the initial position in synchronization with the feeding of the sheet.

4. The method of claim 3, wherein the processing machine is a printing press, and the step of moving the slidable suction means comprises operating a press drive, the press drive being coupled to a shaft having an associated cam, the cam engaging a cam follower rigidly coupled to the slidably suction means, thereby moving the cam follower and the slidable suction means in reciprocating motion.

5. The method of claim 1 wherein the step of applying suction comprises operating an electrically operable solenoid, the solenoid being disposed between a source of suction and the slidable suction means thereby providing a pneumatic connection between the source of suction and the slidable suction means when open.

6. The method of claim 1 wherein the step of releasing the suction pressure comprises opening a valve, the opening of the valve being controlled by a switch actuated by the slidable suction means reaching its maximum displacement position.

7. The method of claim 1, wherein the step of detecting the initial lateral position of the sheet relative to the lateral abutment comprises evaluating a voltage signal, wherein a reflection sensor connected to a transducer generates the voltage signal having a value representative of the lateral position of the sheet.

8. A system for laterally aligning at least one sheet on a feed table of a sheet processing machine, the system comprising:

means for aligning the forward edge of the sheet;

a lateral abutment;

sensing means for detecting the lateral position of the sheet relative to the lateral abutment and outputting a signal corresponding the particular lateral position;

means for determining the time required for the sheet to reach a predetermined lateral displacement;

slidable suction means disposed in the feed table and having an upper surface flush with the feed table, the upper surface having at least one aperture for applying suction therethrough;

means for moving the slidable suction means in a lateral direction toward and away from the lateral abutment;

means for controllably applying suction pressure through the upper surface of the slidable suction means;

control means responsive to the signal output from the sensing means and electrically coupled to the means for controllably applying suction for applying suction through the upper surface of the slidable suction means to couple the sheet to the upper surface and laterally pull the sheet towards the lateral abutment in response to and for the time determined by the determining means; and means for releasing the suction pressure when the suction means reaches the predetermined lateral displacement position which corresponds to the sheet being aligned on the lateral abutment.

9. The system of claim 8 wherein the means for controllably applying suction pressure through the upper surface of the slidable suction means includes a electrically-operable solenoid pneumatically connected between the slidable suction means and a constant source of suction.

10. The system of claim 8 wherein the sheet processing machine is a printing press, the system further comprising a press drive and a suction tube, wherein the slidable suction means comprises a sucker pneumatically coupled to the suction tube, the sucker including a perforated surface, and a slide slidably mounted on the suction tube and rigidly coupled to the sucker, and the means for moving the slidably suction means comprises a cam follower engaging a cam mounted on a shaft coupled to the press drive, wherein the cam follower is rigidly attached to the slide thereby moving the slide in reciprocating motion across the suction tube when the shaft is driven by the press drive.

11. The system of claim 10 wherein the means for releasing the suction pressure includes a switch and a valve electrically operated by the switch, the valve being pneumatically connected between the suction tube and the atmosphere, wherein the switch is mechanically actuated by the slidable suction means when the suction means reaches the predetermined lateral displacement position thereby opening the valve to atmosphere.

12. The system of claim 8, wherein the sensing means comprises a reflection sensor connected to a transducer, such that the sensor and transducer provide a voltage signal having a value representative of the lateral position of the sheet.

13. The system of claim 12 wherein the means for aligning the forward edge of the sheet comprises at least one forward abutment and the voltage signal having a value representative of the lateral position of the sheet is provided when the forward edge of the sheet has aligned on the forward abutment.

14. The system of claim 8 further comprising a sheet feeder for periodically releasing sheets for movement along a feed table in synchronization with the lateral movement of the slidable suction means.

* * * * *